US008127733B2

(12) United States Patent
Lohr

(10) Patent No.: US 8,127,733 B2
(45) Date of Patent: Mar. 6, 2012

(54) AIR INTAKE SYSTEM FOR INTERNAL COMBUSTION ENGINE

(75) Inventor: John Carl Lohr, Beverly Hills, MI (US)

(73) Assignee: Ford Global Technologies, Dearborn, MI (US)

( * ) Notice: Subject to any disclaimer, the term of this patent is extended or adjusted under 35 U.S.C. 154(b) by 532 days.

(21) Appl. No.: 12/406,993

(22) Filed: Mar. 19, 2009

(65) Prior Publication Data

US 2010/0236513 A1 Sep. 23, 2010

(51) Int. Cl.
*F02M 35/10* (2006.01)
*F02D 9/08* (2006.01)

(52) U.S. Cl. ..... 123/184.21; 123/184.61; 123/337

(58) Field of Classification Search ..... 123/184.21, 123/184.61
See application file for complete search history.

(56) References Cited

U.S. PATENT DOCUMENTS 4,901,681 A * 2/1990 Pozniak et al. ..... 123/184.31
5,236,216 A 8/1993 Ratzek
5,341,773 A * 8/1994 Schulte et al. ..... 123/184.61
5,769,045 A * 6/1998 Edwards et al. ..... 123/184.61
5,924,398 A 7/1999 Choi
5,967,116 A * 10/1999 Kawashima et al. ..... 123/337
5,988,119 A 11/1999 Trublowski et al.
6,176,213 B1 * 1/2001 Arnegger ..... 123/184.61
6,343,583 B1 * 2/2002 Nishida ..... 123/184.38
6,427,655 B2 * 8/2002 Itoh et al. ..... 123/184.42
6,491,020 B2 12/2002 Kotchi et al.
6,694,940 B2 * 2/2004 Kawai ..... 123/184.21
6,868,813 B2 * 3/2005 Zimmermann et al. . 123/184.46
6,988,478 B2 * 1/2006 Tanikawa et al. ..... 123/184.42
7,032,501 B2 4/2006 Boertje et al.
7,047,935 B2 5/2006 Arai et al.
7,128,038 B2 * 10/2006 Kawai et al. ..... 123/184.21
2006/0191505 A1 * 8/2006 Doko et al. ..... 123/184.59
2008/0110331 A1 5/2008 Bickle et al.

* cited by examiner

*Primary Examiner* — Michael Cuff
*Assistant Examiner* — Grant Moubry
(74) *Attorney, Agent, or Firm* — Jerome R. Drouillard; Julia Voutyras

(57) ABSTRACT

An air intake system for internal combustion engine includes an intake manifold having an inlet flange and a throttle body attached to inlet flange. The throttle body includes a matching throttle body flange which physically mates with the intake flange. A friction promoting surface having a positive coefficient of sliding friction is incorporated in at least one of the inlet flange and the throttle body flange so that sliding motion of the throttle body relative to the intake manifold will be resisted.

13 Claims, 2 Drawing Sheets

AIR INTAKE SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to an air intake system for providing combustion air to an internal combustion engine.

2. Related Art

Internal combustion engines typically use air intake manifolding to provide both fresh air and recirculated exhaust gases (EGR) to the engine's cylinders. Typically, a throttle body is attached to the intake manifold by threaded fasteners. Because of the necessity for attaching various linkages and other devices to the throttle body, the throttle body is often subject to various pushing and pulling forces, some of which may cause the throttle body to move relative to the intake manifold. This movement is undesirable because it may cause the throttle body's fasteners to loosen, thereby permitting air to leak through the joint extending between the throttle body and the intake manifold. Such air leaks may be a problem because air leaking through the joint is not metered air. In other words, it is not air which has passed through an air flow meter and therefore the engine's control computer will not be able to account for the air; this could cause an issue with the engine's control system.

The problem of maintaining the throttle body in tight contact with an intake manifold is frequently exacerbated with the use of composite intake manifolds, because the composite materials are often more prone to creep and consequent loss of fastener tension.

It would be desirable to provide an intake system in which the intake manifold and throttle body have features which tend to prevent loosening of the throttle body upon the intake manifold.

SUMMARY OF THE INVENTION

According to a first aspect of the present invention, an air intake system for an internal combustion includes an intake manifold having an inlet flange. A throttle body is mounted to the inlet flange, with the throttle body including a valve body, and a throttle body flange attached to the valve body, for engaging the inlet flange of the intake manifold. A friction promoting surface is incorporated in at least one of the inlet flange and the throttle body flange, so that sliding motion of the throttle body relative to the intake manifold will be resisted.

According to another aspect of the present invention, the throttle body further includes a rotatable throttle valve mounted within the throttle body.

In a first preferred embodiment, the throttle body flange and the valve body are one-piece.

According to another aspect of the present invention, a friction promoting surface incorporated in at least one of the inlet flange and the throttle body flange may include a roughened segment formed upon either one or both of the flanges.

According to another aspect of the present invention, the intake manifold may be formed of molded plastics, with the throttle body comprising a metallic fabrication. Alternatively, the intake manifold and throttle body may both be formed from metals or non-metallic composites.

According to another aspect of the present invention, a friction promoting surface may include a pressure-responsive friction promoting surface incorporated in at least one of the inlet flange and the throttle body flange, so that sliding motion of the throttle body flange and the throttle body with respect to the inlet flange and the intake manifold will be resisted when the throttle body is mounted to the intake manifold. The pressure-responsive friction promoting surface may include a roughened segment formed upon an inlet flange mating surface of the throttle body flange, with the roughened segment producing a coefficient of sliding friction between the throttle body flange and the inlet flange which increases as clamping pressure caused by the plurality of fasteners increases.

It is an advantage of an air intake system according to the present invention that precise alignment of a throttle body will be maintained with the intake manifold without the use of shear pins or other devices which add undesirable cost or weight, while at the same time requiring very high precision machining which adds additional cost to manufacturing of the air intake system.

It is yet another advantage according to the present invention that the present system may be used with an intake system having metallic or non-metallic intake manifold and throttle body.

It is yet another advantage according to the present invention that the present system increases the reliability of the complete air intake system by helping to prevent unwanted air leaks in the throttle body-to-intake manifold joint.

Other advantages, as well as features of the present invention, will become apparent to the reader of this specification.

DETAILED DESCRIPTION OF THE PREFERRED EMBODIMENTS

Figure 1:
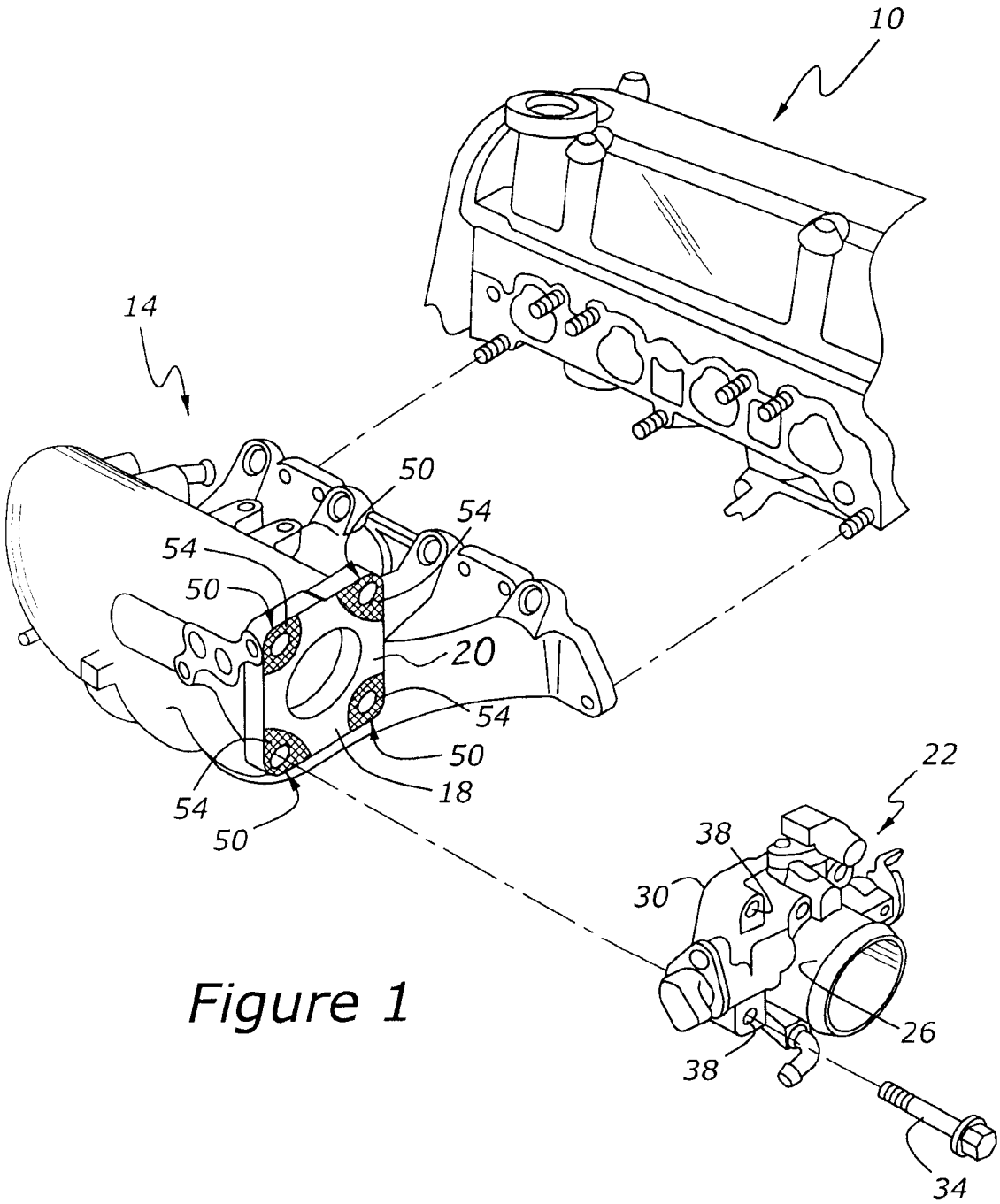
FIG. 1 is a perspective view of a portion of an engine including an air intake system according to an aspect of the present invention.

As shown in FIG. 1, an engine, 10, has an intake manifold, 14, with an inlet flange, 18. A throttle body, 22, is attached to intake manifold 14 with several threaded fasteners, 34. In the absence of the improvement according to the present invention, loss of tension from fasteners 34 may allow throttle body 22 to shift with respect to intake manifold 14.

Intake manifold 14 and throttle body 22 are joined together at inlet flange 18, which, as noted above, is part of intake manifold 14, and usually one piece with intake manifold 14, and throttle body flange 30, which in a preferred embodiment, is one piece with valve body 26. Throttle body 22, as its name implies, has a rotatable throttle plate or valve 28, which is shown in FIG. 2.

Figure 2:
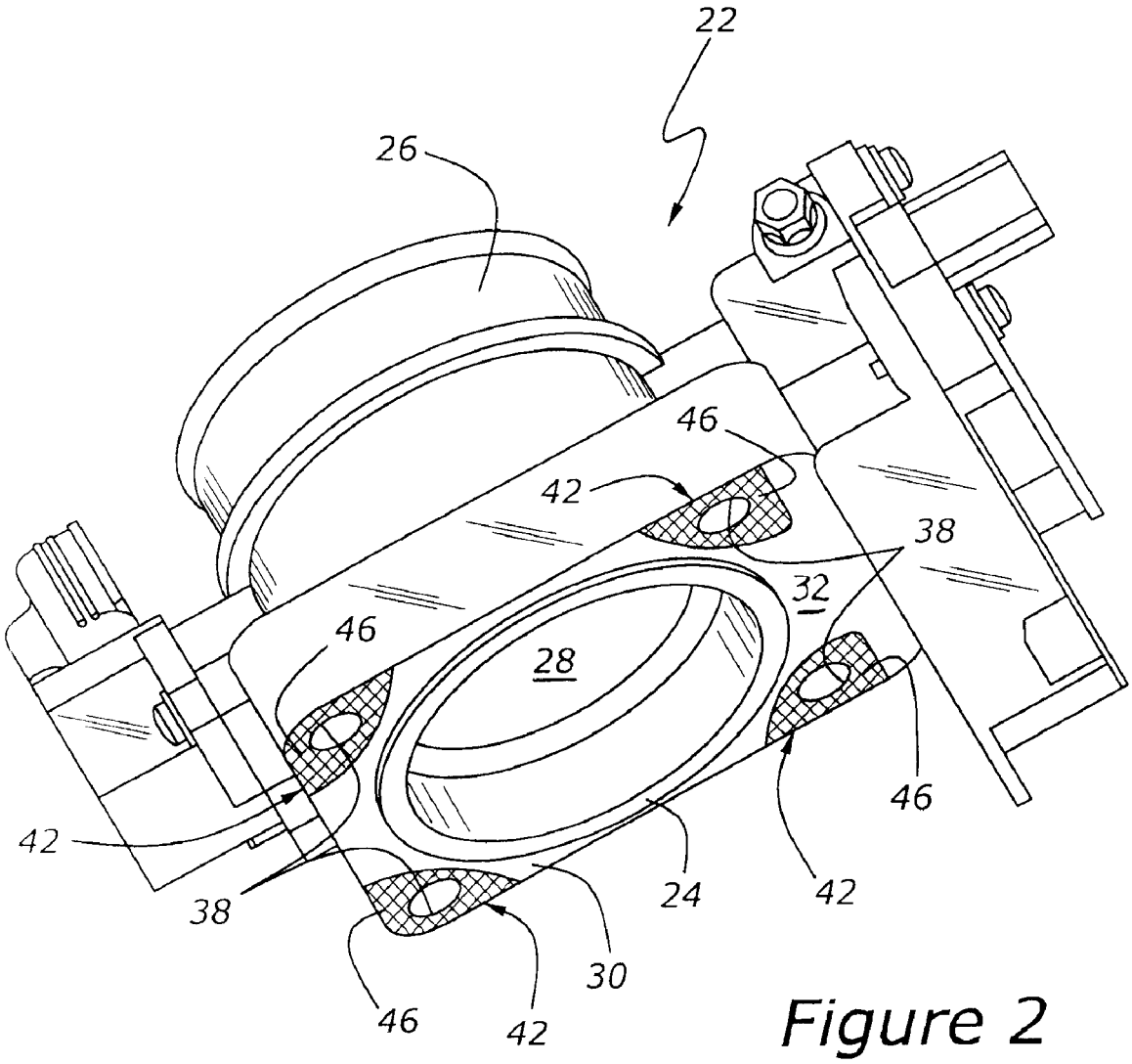
FIG. 2 is a perspective view of a throttle body according to an aspect of the present invention.

FIG. 2 shows a number of friction promoting surfaces, 42, located on throttle body flange 30 in regions of inlet flange mating surface 32 which surround fastener bores 38. Fasteners 34 are inserted through fastener bores 38 for the purpose of mounting throttle body 22 to intake manifold 14. Friction promoting surfaces 42 are roughened segments which may be produced by knurling as shown at 46 in FIG. 2, and also shown at 54 in FIG. 1 as being formed in throttle body flange mating surface 20. Thus, intake manifold 14 has a number of friction promoting surfaces, 50, having knurling 54.

Those skilled in the art will appreciate in view of this disclosure that friction promoting surfaces 42 and 50 may be produced not only by knurling, but by other methods generating a mechanically upset surface having a positive coefficient of sliding friction between throttle body flange 30 and inlet flange 18, with the coefficient of sliding friction increasing as clamping pressure caused by fasteners 34 increases.

Throttle body 22 is shown as having a gasket, 24, included as part of throttle body flange 30. The gasket could, however, be incorporated in inlet flange 18 as an alternative.

Although in a first preferred embodiment intake manifold 14 is fabricated of a plastics material, and valve body 26 is fabricated of a metallic material, those skilled in the art will appreciate in view of this disclosure that both intake manifold 14 and valve body 26 could be comprised of metallic or non-metallic composites and other materials commonly employed in the fabrication of intake systems. What is important is that a roughened friction promoting surface having a positive coefficient of friction responsive to clamping force imposed by fasteners 34 be employed on one or both of the intake manifold and throttle body mating surfaces.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An air intake system for an internal combustion engine, comprising:

an intake manifold having an inlet flange comprising a first plurality of fastener bores;

a throttle body mounted to said inlet flange, with said throttle body comprising: a valve body;

a throttle body flange comprising a second plurality of fastener bores, attached to said valve body, for engaging said inlet flange of said intake manifold;

a plurality of fasteners for attaching said throttle body flange to said inlet flange; and a friction promoting surface incorporated in at least one of said inlet flange and said throttle body flange, wherein said friction promoting surface comprises a segment having a roughened surface when compared to a remaining surface of said inlet flange or said throttle body flange, the segment located proximate at least one of said first plurality of fastener bores and said second plurality of fastener bores, whereby sliding motion of said throttle body relative to said intake manifold will be resisted.

2. An air intake system according to claim 1, further comprising a rotatable throttle valve mounted within said valve body.

3. An air intake system according to claim 1, wherein said throttle body flange and said valve body are one piece.

4. An air intake system according to claim 1, wherein said friction promoting surface is formed upon said throttle body flange.

5. An air intake system according to claim 1, wherein said friction promoting surface is formed upon said inlet flange.

6. An air intake system according to claim 4, wherein said roughened surface comprises a knurled texture applied to said throttle body flange.

7. An air intake system according to claim 1, wherein said intake manifold comprises molded plastics and said throttle body comprises a metallic fabrication.

8. An air intake system for an internal combustion engine, comprising:

a molded plastic intake manifold having an inlet flange comprising a first plurality of fastener bores;

a metallic throttle body attached to said inlet flange, with said throttle body comprising:

a valve body;

a throttle body flange comprising a second plurality of fastener bores for engaging said inlet flange of said intake manifold, with said throttle body flange being one-piece with said valve body;

a plurality of fasteners for attaching said throttle body flange to said inlet flange; and a pressure-responsive, friction promoting surface incorporated in at least one of said inlet flange and said throttle body flange, wherein said friction promoting surface comprises a segment haying a roughened surface when compared to a remaining surface of said inlet flange or said throttle body flange, the segment located proximate at least one of said first plurality of fastener bores and said second plurality of fastener bores, whereby sliding motion of said throttle body flange and said throttle body with respect to said inlet flange and said intake manifold will be resisted when the throttle body is mounted to the intake manifold.

9. An air intake system according to claim 8, wherein said pressure-responsive, friction promoting surface is formed upon an inlet flange mating surface of said throttle body flange, with said roughened surface producing a coefficient of sliding friction between said throttle body flange and said inlet flange which increases as clamping pressure caused by said plurality of fasteners increases.

10. An air intake system according to claim 9, wherein said roughened surface comprises a plurality of knurled areas formed upon the inlet flange mating surface.

11. An air intake system according to claim 8, wherein said roughened surface comprising a repeating pattern, mechanically upset surface having a positive coefficient of sliding friction between said throttle body flange and said inlet flange which increases as clamping pressure caused by said plurality of fasteners increases.

12. An air intake system for an internal combustion engine, comprising:

a molded intake manifold having an inlet flange comprising a first plurality of fastener bores;

a throttle body attached to said inlet flange, with said throttle body comprising: a valve body;

a rotatable throttle valve mounted within said valve body;

a throttle body flange comprising a second plurality of fastener bores for engaging said inlet flange of said intake manifold, with said throttle body flange being one-piece with said valve body;

a plurality of fasteners for attaching said throttle body flange to said inlet flange; and a pressure-responsive, friction promoting surface incorporated in at least one of said inlet flange and said throttle body flange, wherein said friction promoting surface comprises a segment having a roughened surface when compared to a remaining surface of said inlet flange or said throttle body flange, the segment located proximate at least one of said first plurality of fastener bores and said second plurality of fastener bores, whereby sliding motion of said throttle body flange and said throttle body with respect to said inlet flange and said intake manifold will be resisted when the throttle body is mounted to the intake manifold, wherein said pressure-responsive, friction promoting surface is formed upon at least one of an inlet flange mating surface of said throttle body flange and a throttle body flange mating surface of said inlet flange, with said roughened segment producing a positive coefficient of sliding friction between said throttle body flange and said inlet flange which increases as clamping pressure produced by said plurality of fasteners increases.

13. An air intake system according to claim 12, wherein each of said inlet flange mating surface and said throttle body flange mating surface comprises a friction promoting surface.

* * * * *